United States Patent [19]

Adamski, Jr. et al.

[11] 4,147,120

[45] Apr. 3, 1979

[54] AUXILIARY FEED MECHANISM FOR SEWING MACHINES

[75] Inventors: Maximilian Adamski, Jr., Wheeling; Robert C. Talsma, Glen Ellyn; Richard E. Walters, Hoffman Estates, all of Ill.

[73] Assignee: Union Special Corporation, Chicago, Ill.

[21] Appl. No.: 833,110

[22] Filed: Sep. 14, 1977

[51] Int. Cl.[2] ..... D05B 21/00

[52] U.S. Cl. ..... 112/318; 112/121.12; 112/121.26

[58] Field of Search ..... 112/211, 210, 121.11, 112/275, 277, 220, 121.12, 121.26, 214; 318/39, 77, 78

[56] References Cited

U.S. PATENT DOCUMENTS

| | | | |
|---|---|---|---|
| 2,907,291 | 10/1959 | Schroder | 112/211 |
| 2,955,553 | 10/1960 | Winberg | 112/211 |
| 3,024,395 | 3/1962 | Pedersen et al. | 318/77 X |
| 3,351,831 | 11/1967 | Hemphill et al. | 318/77 |
| 3,496,892 | 2/1970 | Marforio | 112/214 X |
| 3,761,790 | 9/1973 | Daab | 112/275 |
| 3,799,084 | 3/1974 | Furnari | 112/210 X |
| 3,867,889 | 2/1975 | Conner, Jr. | 112/121.11 |
| 3,878,761 | 4/1975 | Makowski | 318/39 X |
| 3,899,986 | 8/1975 | Conner, Jr. | 112/214 |
| 3,921,770 | 11/1975 | Daab et al. | 112/277 X |
| 3,972,297 | 8/1976 | Melcharick | 112/275 |
| 3,980,032 | 9/1976 | Kleinschmidt et al. | 112/121.11 |
| 3,994,247 | 11/1976 | Cummins | 112/210 |
| 4,067,276 | 1/1978 | Mahilo et al. | 112/220 |

*Primary Examiner*—Werner H. Schroeder
*Assistant Examiner*—A. M. Falik
*Attorney, Agent, or Firm*—John W. Harbst; John A. Schaerli

[57] ABSTRACT

An auxiliary feed mechanism adapted for use with a sewing machine including a feed roller for advancing the workpiece through the work station and a mounting structure adapted to move the feed roller between two positions in one of which the feed roller is operative to aid in feeding the workpiece through the workstation and in the other of which the feed roller is rendered ineffective to transmit motive power to the workpiece. A plurality of flexible couplings drive the feed roller in timed relation to the actuation of a variable speed drive motor which is coupled in a unique electric circuit relationship with the main drive motor of the machine so as to vary the feeding rate of the feed roller in accordance with the machine cycle rate.

19 Claims, 7 Drawing Figures

AUXILIARY FEED MECHANISM FOR SEWING MACHINES

CROSS REFERENCES

This application is related to and, for further background information reference should be made to the following copending application: M. Adamski, Jr., et al, Ser. No. 733,604, Filed Oct. 18, 1976 now U.S. Pat. No. 4,098,201.

BACKGROUND OF THE INVENTION

This invention relates generally to sewing machines and more particularly is concerned with an auxiliary feed mechanism associated therewith.

The industrial sewing machine industry has consistently sought ways by which an auxiliary feeding action may be placed upon the workpiece as the latter is fed through the stitching point of the machine. This is especially required when joining multiple layers of material or when it is necessary to reposition a workpiece that has been displaced from its normal course of travel. As disclosed in the above identified application, that portion of the workpiece immediately rearward of the presser foot is displaced from its normal path of travel by a rear ejector system. However, to assure the manufacture of an acceptable garment it is necessary to guide this displaced portion of the workpiece back to its normal path so that the remainder of the workpiece remains unaffected. As is apparent if the auxiliary feed mechanism of the machine has a feed rate velocity equal to the feed rate velocity of the feed mechanism of the machine the material that has been displaced will remain in that path of travel unless some outside force is applied thereto to return same to its normal path of travel. In addition to the above, it is desirous in some sewing operations to aid the feed mechanism of the machine in continually advancing the workpiece through the work station and to continually run after the machine stops in order to pull the material through the machine. It is also a common desire in some sewing operations to gather or stretch the fabric plies and then be able to come back to the normal condition rapidly without any further readjustment of the auxiliary feed machanism.

It is known in industrial type sewing machines to impart a concomitant feeding motion to the workpiece by use of a puller mechanism assembly in order to assist the sewing head during the sewing operation. Attempts have been made by using pullers which include upper and lower (top and bottom) rollers which contact the fabric after sewing so as to pull the workpiece through the sewing station. As is apparent, if the puller mechanism is going to aid in advancing the workpiece it is required to move in excess of the speed of the feed mechanism of the machine. However, the excess speed requirement sometimes requires the use of additional mechanisms so as to achieve the desired ratio as well as to allow adjustment of said ratio.

Such devices known for concomitantly feeding the workpiece in relation with the feed mechanism of the machine have the disadvantage of usually requiring cumbersome supports and guides which must be situated about the sewing head so as to derive power therefrom. This leads to another disadvantage in that the higher speeds of todays machines require a minimum of loading to be placed on the machine so that quick acceleration and the higher speeds of the machine may be achieved. As mentioned above, and as is apparent the auxiliary feed mechanisms are usually set to run faster than the speed at which the feed mechanism is moving in the material workpiece so as to aid the machine feed mechanism but unless this quicker speed is calculated quite carefully undesired gathering of the material workpiece could result in excess gathering over that which is desired and therefore the ends of the workpiece may not end up equal. In this regard, the lack of an adequate adjustability factor is yet another drawback in the heretofore known devices. That is, once the speed of the auxiliary feed mechanism has been adjusted it has not been possible to vary the speeds of said mechanism during sewing. Furthermore, with the heretofore known devices the torque of the auxiliary feed mechanism has not been fully developed until the sewing machine has attained its full or required speed, whereas it is desirous to achieve full torque of the auxiliary feed mechanism as quickly as possible so as to advance the workpiece in conjunction with the speed of the feed mechanism of the machine.

SUMMARY OF THE INVENTION

In view of the above, and in accordance with the present invention there is provided an auxiliary feed mechanism which serves the purpose of concomitantly aiding the feed mechanism of the machine in advancing the workpiece through the stitching point. The reader's attention is specifically and expressly directed to the fact that, while the present invention will be described for and in terms of an auxiliary feed mechanism mounted proximate the area of the machine the present invention contemplates a feed attachment for use in an area remote from the sewing machine while remaining operably associated therewith for certain sewing operations.

The auxiliary feed mechanism according to this invention includes a feed roller which is mounted for movement between two positions. In one but not the other of said positions, the feed roller is operative to advance the workpiece in a unique timed relation with the advancement of same by the feed mechanism of the machine. A bracket rotatably secured to the machine support is employed for carrying the roller between its respective positions. Operably associated with the bracket is a drive force member which is connected to the logic circuitry of the machine so as to move the feed roller in proper sequence to the sewing operation. A plurality of flexible couplings are employed to connect the feed roller with a variable speed drive motor. The flexible couplings allow the feed roller to be moved from one position to the other without any interruption in force transfer from the motor. The variable speed drive motor is synchronously associated with the main drive motor of the machine through a unique electrical circuit arrangement. At the onset of the stitching operation the rear ejector system displaces a portion of the workpiece on the downstream side of the presser foot. The electronic circuitry of the present invention controls the variable speed motor so as to drive the feed roller at a feeding rate which is greater than the feeding rate of the feed mechanism of the machine for a predetermined period of time. The difference in feed rate velocities results in a component force vector being placed on that portion of the workpiece situated between the presser foot and the feed roller so as to cause the mispositioned portion of the workpiece to be drawn back into its proper path. Further to this, the electronic circuitry of the present invention includes means which "track" the speed of the machine. The term "tracking" throughout the specification here to follow means that the main drive motor and the variable speed motor both produce signals which are received by the electronic circuitry of the present invention which in turn produces a signal that controls the speed of the variable speed motor as a function of the speed of the main drive motor. This is to say that when the main drive motor of the machine increases or decreases in speed the variable speed motor will be directly affected by said change. It is also possible through means of the electronic circuitry rather than through belts and adjustable mechanisms to easily adjust the feeding ratio than as has been heretofore known in the art. The driving force of the auxiliary feed mechanism which has traditionally been transmitted from the sewing machine head to the feed roller of the machine has now an independent source of power so as to alleviate forces from the sewing head and in this way it is possible to maintain the higher speeds required of todays sewing operations. Also besetting the prior art puller mechanisms are the problems of complexity of design, difficulty of installation as associated with the sewing head, and sensitivity to maladjustment, all of which contribute to relatively high initial cost and inordinate demands relating to maintenance of the devices after their installation and all of which have been alleviated by the present invention.

Accordingly, the main object of this invention is the provision of an auxiliary feed mechanism for a sewing machine which is independent of the mechanization of the sewing machine.

Another object of this invention is to provide an auxiliary feed mechanism which is capable of varying the feeding rate of the workpiece relative the rate of feed of same by the feed mechanism of the machine during the sewing cycle.

Another object of this invention is to provide an auxiliary feed mechanism which can be used concomitantly with the feed mechanism of the machine but yet disposed remote therefrom.

Yet another object of the present invention is the provision of an auxiliary feed mechanism which is electrically operated.

Yet a further object of this invention is to provide an auxiliary feed mechanism capable of very rapidly being mounted upon a conventional sewing machine by a relatively unskilled person.

Still another object is the provision of an attachment as aforesaid, for use with material handling systems and machines other than industrial sewing machines.

Yet another object of the present invention is to provide an auxiliary feed mechanism which is relatively inexpensive and which will operate relatively efficiently and in synchronous response to the relatively high machine speeds of the machine.

These features and other features of this invention will be pointed out in further detail in the following description according to a preferred, but not exclusive embodiment given merely as an example and not restrictively in the attached drawings.

BRIEF DESCRIPTION OF THE DRAWINGS

The invention is illustrated by way of example in the accompanying drawings which form part of this application and in which.

DESCRIPTION OF THE PREFERRED EMBODIMENT

Figure 1:
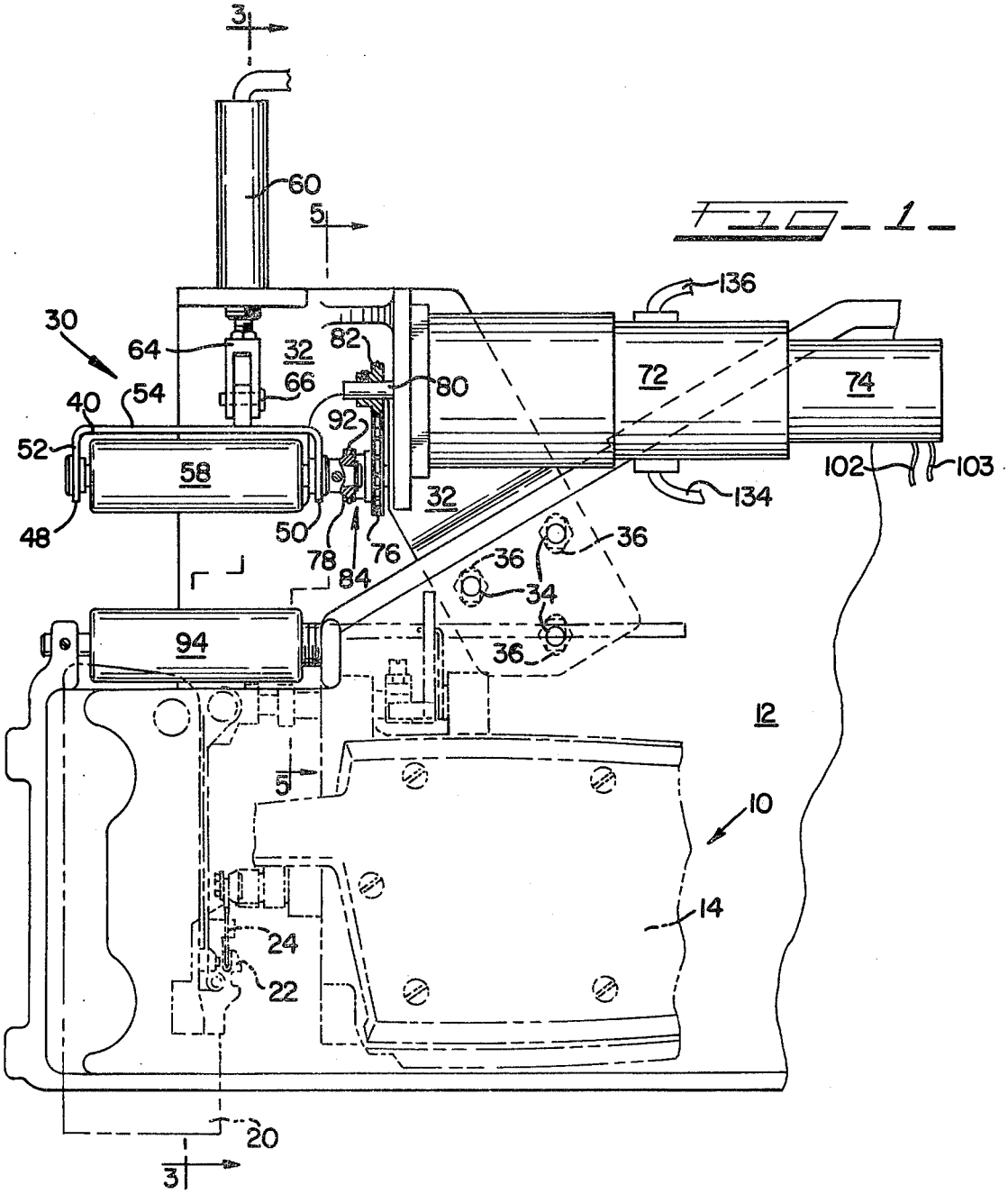
FIG. 1 is a partial top plan view of the present invention showing same as attached to the machine support.
Figures 3, 5:
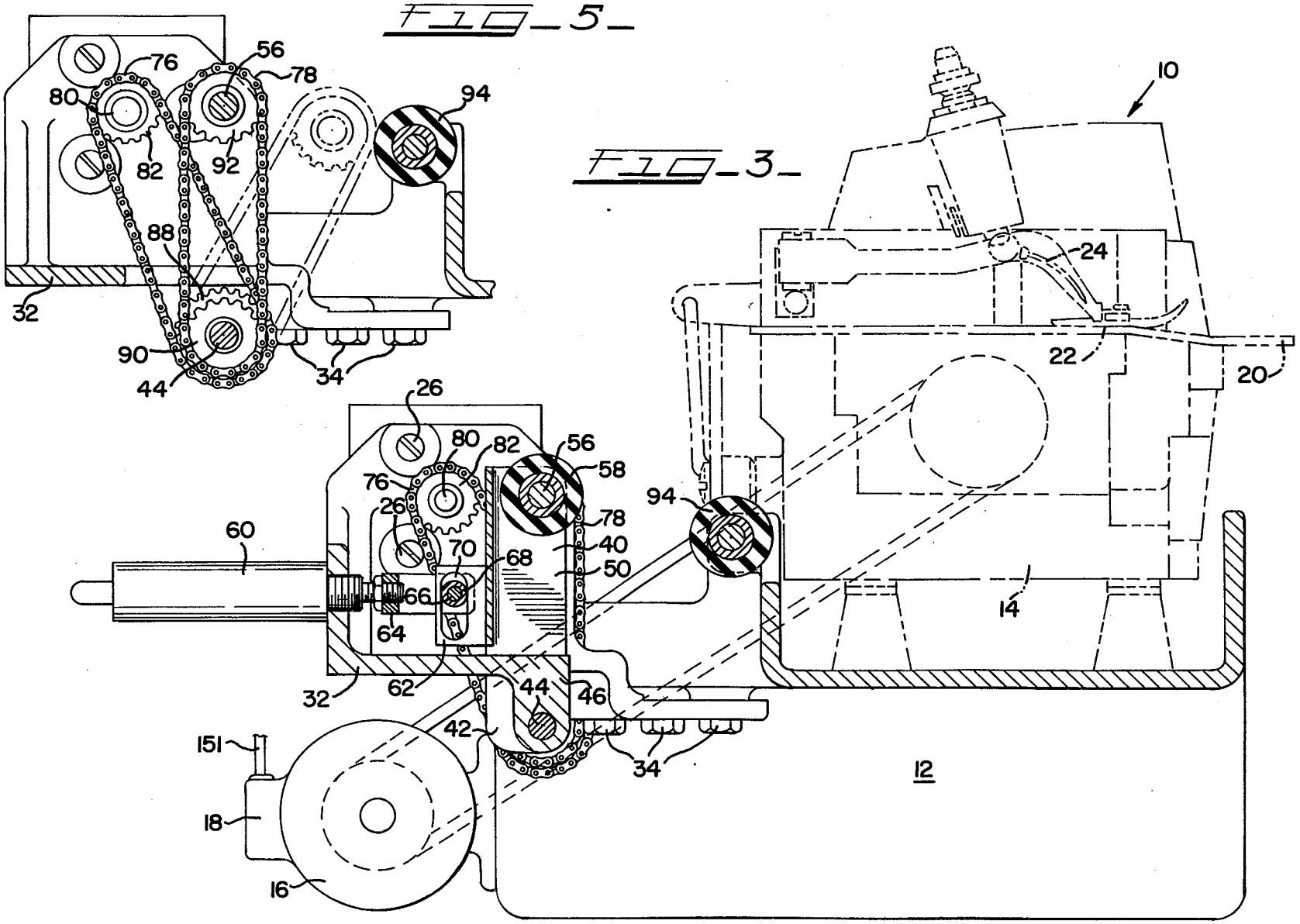
FIG. 3 is a cross sectional view of the present invention taken along line 3—3 of FIG. 1 and showing the auxiliary feed mechanism in a non-engaging position.
FIG. 5 is a partial cross sectional view taken along line 5—5 of FIG. 1 and showing in phantom lines the different positions of which the present invention is capable of moving.
Figure 4:
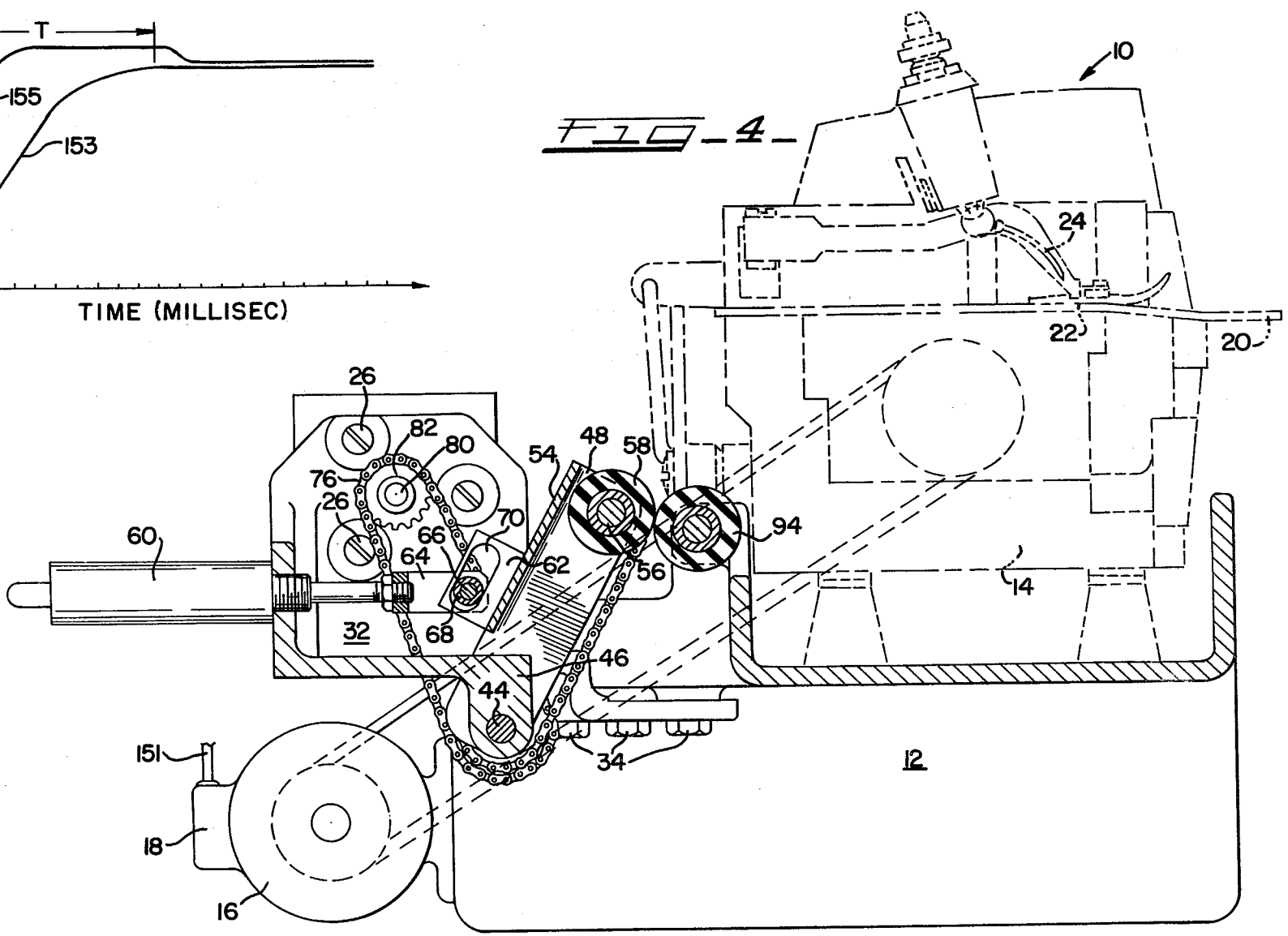
FIG. 4 is a side elevational view similar to FIG. 3 but showing the auxiliary feed mechanism of the present invention in the engaging position.

Referring now in more detail to the drawings in which like reference numerals indicate like parts throughout the several views, the present invention shown in FIGS. 1, 3 and 4 depicts partially in phantom lines a conventional sewing machine 10 which is supported on a table or support means 12. The machine includes a frame means 14 and a main drive motor means 16 for driving said machine. The main drive motor means 16 is a commercial apparatus such as a Quick 880 motor which is modified somewhat for this particular operation. The motor means 16 is provided with suitable electronic sensing means 18 which is adapted to produce a set of electric impulses or signals representative of the speed of motor means 16. This apparatus is commercially available and is mentioned here only for the purpose of adequately describing certain additions which follow. The sewing machine 10 further includes a work support means 20 which is hingedly connected to the frame means 14 and is adapted to hold a workpiece in position for subsequent penetration at a stitching point generally indicated as 22 and which is defined by the reciprocating needle means 24. The sewing machine 10 further includes a feed mechanism means (not shown) which is well known in the art as is apparent from viewing U.S. Pat. No. 2,704,042 granted Mar. 15, 1955 to N. L. Wallenberg et al. From the art herein cited, it is apparent that the sewing machine and associated mechanism are well known in the art and therefore no further description will be devoted thereto. Further, the sequential logic operation of a machine of this sort and related electrical circuitry for automatically controlling the operation of the sewing cycle are described in the above mentioned patent application, incorporated herein by reference, and thus no further description will be devoted thereto.

Figure 2:
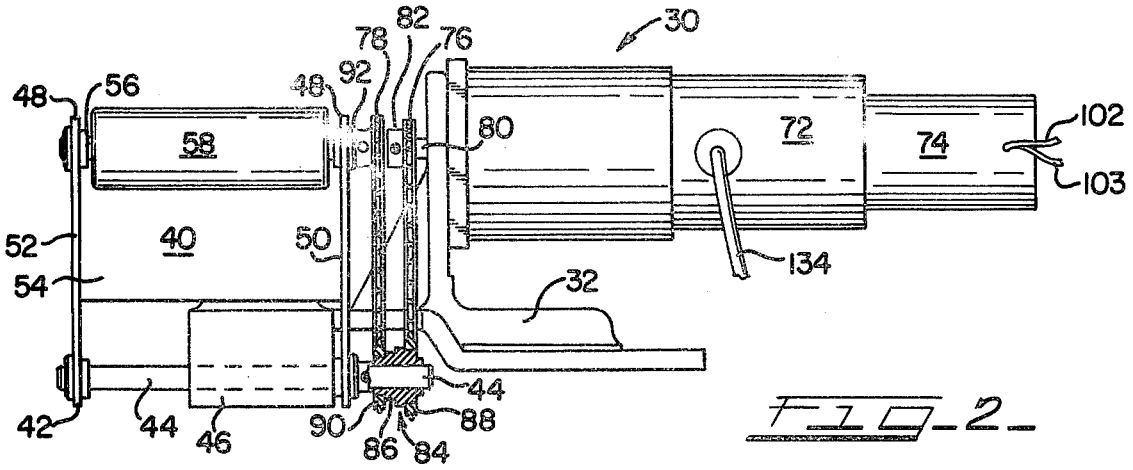
FIG. 2 is a front elevational view showing the present invention as removed from the frame of the sewing machine.

Turning now to FIGS. 1 and 2, the auxiliary feed mechanism means is generally indicated by the reference numeral 30. The auxiliary feed mechanism means 30 of the present invention includes a mounting or support means 32 which supports various components and elements and which is secured in this preferred embodiment by means of fasteners such as bolt means 34 to the table means 12. It should be appreciated that the mounting means 32 is provided with elongated slot means 36 which allow for passage of the attaching means 34 through the mounting means and also allow for movement of the entire auxiliary feed mechanism means 30 relative to the frame means 14 of the machine 10.

As shown in FIG. 2 and 3 a reciprocal bracket means 40 is rotatably secured at its first end means 42 to the support means 32 by means of a freely rotatable shaft means 44 which is carried by a depending lug means 46 formed as part of the mounting means 32. The bracket means 40 includes a pair of flat parallel outer sidewalls 50 and 52 which are spaced but yet joined to each other by wall means 54. Journaled for rotation at the second end means 48 of bracket means 40 is a second freely rotatable shaft means 56 which carries a drive member or feed roller means 58. The feed roller means 58 is provided to advance or feed the work material through the work station concomitantly with the advancement of same by the feed mechanism of the machine.

Reciprocation of the bracket means 40 about the horizontal axis of shaft means 44 is accomplished by the actuation/deactuation of a force driver means 60 which in the preferred embodiment is in the form of a pneumatic cylinder. Suitable connections are provided for rocking the bracket means 40 and thereby causing the feed roller means 58 to move between its inoperative position shown in FIG. 3 and its operable position shown in FIG. 4. The suitable connections for operably connecting the force driver means 60 with the bracket means 40 include a block means 62 secured to wall means 54. The driving end 64 of the force driver means 60 carries a pin means 66 on which is journaled a roller element means 68 which cooperates with an elongated slot means 70 in block means 62. The slot means 70 permits a slight sliding movement of the roller element means 68 toward the top and bottom of the slot means 70 as seen in FIGS. 3 and 4, as the bracket is rocked through a suitable angle so as to move the drive member means 58 into operative position. It should be noted that the force driver means 60 is interconnected with the logic system of the machine so that rocking movements of the bracket means 40 and the feed roller means 58 carried thereby are in timed relation with the sewing cycle of the machine 10.

As seen in FIGS. 1 and 2, secured to the mounting means 32 by any suitable means such as 26 (FIG. 3) is a variable speed motor means 72. The variable speed motor means of the present invention is a commercially available unit such as an Electro-Craft motor, Model No. E586. The motor means 72 is adapted to impart motion to the feed roller means 58 in a manner hereinafter described. Operably associated with the variable speed motor means 72 is a sensing means 74 which in the preferred embodiment is in the form of a tachometer means. The sensing means 74 includes means adapted to produce a set of signals representative of the speed of the motor means 72.

So as to allow reciprocatory movement of the bracket means 40 without a loss of force transfer between the motor means 72 and th a manner hereinafter described. Operably associated with the variable speed motor means 72 is a sensing means 74 which in the preferred embodiment is in the form of a tachometer means. The sensing means 74 includes means adapted to produce a set of signals representative of the speed of the motor means 72.

So as to allow reciprocatory movement of the bracket means 40 without a loss of force transfer between the motor means 72 and the feed roller means 58, first and second coupling means 76 and 78 respectively have been employed. As best seen in FIGS. 1, 2 and 5, the variable speed motor means 72 is provided with an output shaft means 80 which has secured thereto a sprocket means 82 which is the first in a series of sprocket means. A freely rotatable assemblage means 84 is mounted for rotation on that portion of the shaft means 44 which extends to the right of the wall means 50 as seen in FIG. 2. The freely rotatable assemblage means 84 includes a stepped bushing means 86 which serves to mount second and third sprocket means 88 and 90 respectively in the series of sprocket means. Entrained about the sprocket means 82 and 88 is the first flexible coupling means 76 which is adapted to rotate the assemblage means 84 upon actuation of the variable speed motor means 72. A fourth sprocket means 92 is carried on that portion of shaft means 56 which extends to the right of wall means 50. Entrained about the sprocket means 90 and 92 is the second flexible coupling means 78. In this manner the freely rotatable assemblage means 84 acts as a force transfer member so that the driving force from the motor means 72 is transferred to the freely rotatable assemblage means 84 by means of the first coupling means 76 and is transferred by the assemblage means 84 to the second coupling means 78 via the bushing means 86 and is delivered to the feed roller means 58 by the entrainment of the coupling means 78 over the sprocket means 90 and 92.

As is apparent from FIG. 5, according to the preferred embodiment it is possible to rotate the shaft means 56 which carries the feed roller means 58 from the solid line position shown in FIG. 5 to the phantom line position without a loss of force transfer between the motor means 72 and the feed roller means 58 due to the flexibility built into the system by the couplings 76 and 78.

It should be noticed from FIGS. 3 and 4 that in the preferred embodiment the feed roller means 58 is mounted for movement in a generally horizontal plane beneath the work support means 20 of the machine 10. However, it should be appreciated that the present invention is equally applicable to a machine wherein it is desired to mount the feed roller means 58 for operable association with the work support means 20 of the machine without derivation from the scope of contribution of the present invention to the appropriate art. In view of the fact that the present invention is employed beneath the work support of the machine, it has been found preferable to employ a second roller means 94 which is fixedly secured for rotation on the table means 12 so that as the material workpiece drops from the work support means 20 it is passed between the feed roller means 58 and 94.

Figure 7:
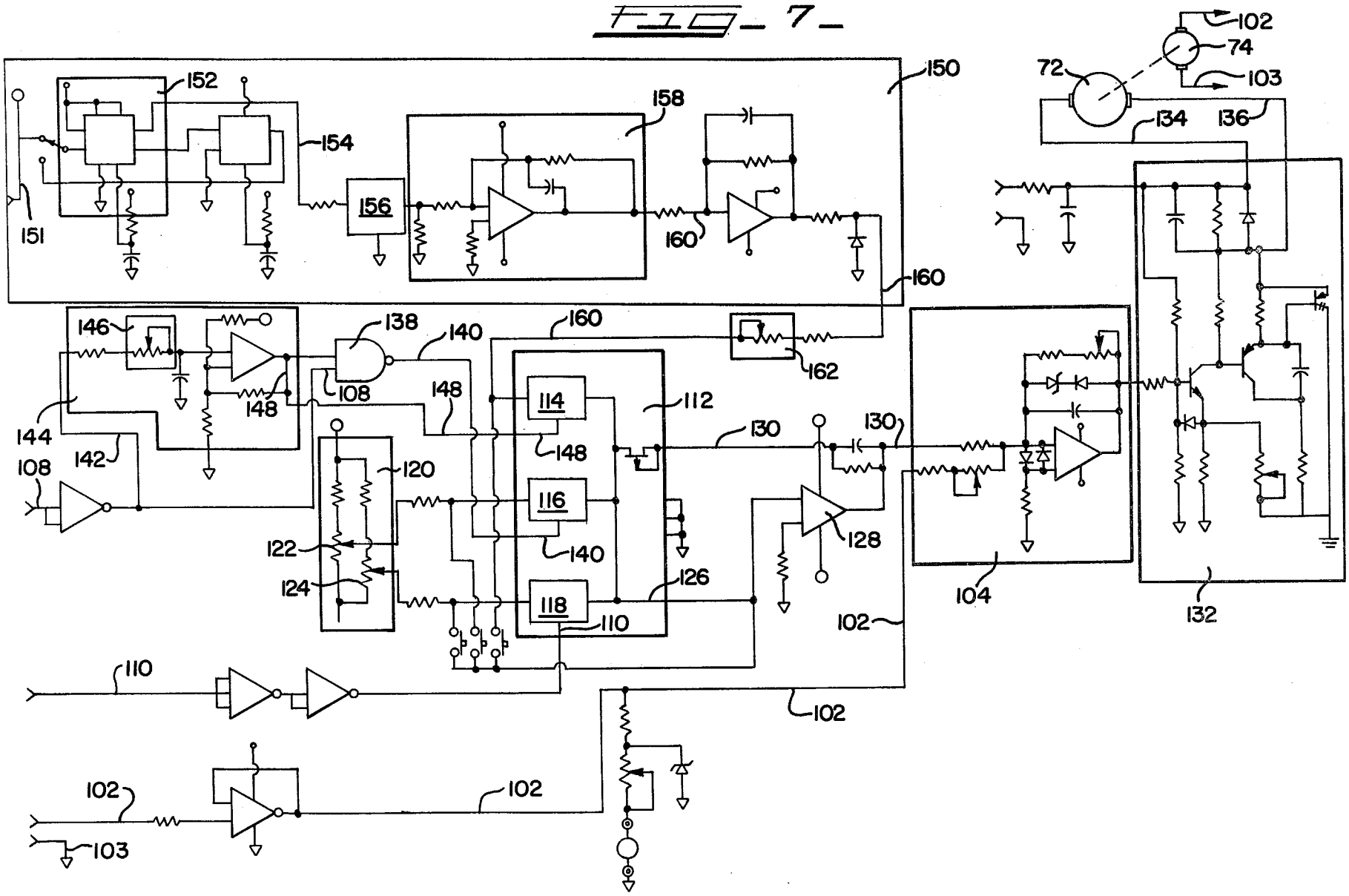
FIG. 7 is an electrical schematic representation of a presently preferred embodiment.

Turning now to FIG. 7, the electrical circuitry associated with the present invention will now be discussed. As mentioned above operably associated with the variable speed motor means 72 is a sensing or tachometer means 74 which senses the speed of the variable speed motor means. The sensing means produces an output signal means which is representative of the speed of the variable speed motor means and this impulse is delivered to the circuitry shown in FIG. 7 over lines 102 and 103. The signal from the sensing means is delivered via line 102 and is one of two inputs for an error amplifier means 104 while line 103 is ground. The logic circuitry for operation of the sewing cycle, incorporated herein by reference from the above identified application, is delivered to the circuitry shown in FIG. 7 via lines 108 and 110 at appropriate time intervals. The electronic circuitry of the present invention further includes a block of switch means 112 which is comprised of switches 114, 116 and 118. It should be appreciated that the sequence of sewing operations associated with the machine in the above identified application operates in three distinct sewing cycles. These three sewing cycles are (1) pre-sew, (2) a transition period between the beginning of the stitching cycle and the top running speed of the sewing cycle, and (3) a constant running speed for the entire cycle. For a more detailed description of the sewing cycle and sewing operation, the readers attention is directed to the above identified application. Operably associated with switch means 116 and 118 is a block of adjustable means 120 which in the preferred embodiment is comprised of potentiometer means 122 and 124 which are employed for governing the pre-sew and transition speed respectively of the machine. At the onset of the sewing cycle, which begins with pre-sew, the logic of the sewing system produces an impulse which is fed via line 110 to the switch means 118 so as to close same. The closing of switch means 118 allows a preset value from the adjustable means 124 to be fed via line 126 to a unity gain inverting amplifier means 128 which in turn delivers this value through line 130 to the error amplifier means 104 whereby acting as the second input therefore. The input value received from the sensing means 74 via line 102 has a zero value since the machine has not yet begun to sew and the variable speed motor has not yet begun to pull the fabric through the work station. Therefore, one input to the error amplifier means 104 has a value equal to zero. The value received from the potentiometer means 124 and fed to the error amplifier means 104 and acting as the second input therefore has a value greater than that value received from the sensing means 74 in view of the fact that the adjusting means 124 sets the speeds in which the sewing machine is to sew during the pre-sew cycle. These two values, that is the value delivered to the error amplifier mens 104 which is representative of the speed of the motor means 72 and the preset value of adjustable means 124 which is representative of presew speed, are compared and the difference therebetween is delivered to a power amplifier means 132. The power amplifier means 132 is connected via lines 134 and 136 to the variable speed motor means 72. The value or signal delivered by the power anplifier means 132 governs and drives the motor means 72 at a predetermined speed.

After a predetermined period of time has lapsed for the pre-sew cycle, the logic circuitry of the machine switches power from line 110 to line 108 which is connected to a nand gate means 138. The absence of an impulse in line 110 causes the switch means 118 to again open whereby taking away from the error amplifier means 104 the impulse delivered thereto via line 130 which in effect disconnects the adjustable means 124 from supplying any input to means 104. A line 140 connects the nand gate means 138 with switch means 116 which due to the presence of an impulse now becomes closed. As mentioned above switch means 116 to operatively associated with adjustable means 122. The closing of switch means 116 allows the predetermined value, of switch means 122, representative of the transition speed for machine 10, to be fed to the error amplifier means 104 via line 130. The value delivered to the error amplifier means 104 via line 130 is again compared to the value created by sensing means 74 and fed to the error amplifier means 104. The value sensed by sensing means 74 is equal to the speed at which the motor means 72 is turning, or the speed for the pre-sew cycling operation. The value received from the sensing means 74 is compared with the value from adjustable means 122. These two values are compared by the error amplifier means 104 and the difference therebetween is again delivered to the power amplifier means 132 which in turn controls the speed of the motor means 72 and via the flexible couplings 76 and 78, discussed above, drives the feed roller means 58 at a predetermined rate of feed. At the same time as the logic impulse is delivered to the nand gate means 138 via line 108 this impulse is also diverted to a time delay circuit means 144 via line 142. The time delay circuit means 144 allows a sufficient time, or transition time, which allows the sewing machine to start up and reach its top sewing speed. The time delay circuit means 144, once it has allowed a sufficient period of transition time, switches the nand gate means 138 from its transitional period time position to a second position. It should be noted that there is included within the time delay circuit means an adjustable means 146 which allows adjustment of the length of the transitional time. Once the nand gate means 138 has been switched from its transitional time setting to its second position the impulse delivered via line 140 to switch means 116 is removed therefrom which in turn causes switch means 116 to open. Once the switch means 116 has been moved to its open position the value of adjustable means 124 which is being delivered to the error amplifier means 104 via line 130 is removed therefrom.

The switching of nand gate means 138 from its transitional period time setting to its second position allows an impulse to be delivered to switch means 114 via line 148 whereby closing same. The closing of switch means 114 allows a unique sewing machine speed measuring circuit means 150 now to become effective. Included within the sewing machine speed measuring circuit means 150 is a pulse width generator means 152 which receives an electric impulse from the Quick 880 motor via the sensing means 18 associated therewith. The sensing means 18 associated with the main drive motor means 16 is connected to the pulse width generator means via line 151. It is well within the scope of this invention that the sensing means 18 could likely measure the speed of needle reciprocation and/or the feed rate of the feeding mechanism since both of these can be considered as a function of the speed of the motor. Line 154 connects the pulse width generator means 152 with an amplitude limiter means 156 which in turn is connected to an average integrator means 158 and via line 160 to switch means 114. It should be appreciated, that before the impulse produced by the average integrator means reaches switch means 114 an adjustable means 162 is in series therewith for reasons discussed hereinafter. The value produced by the average integrator means 158 which is representative of the speed of the main drive motor means 16 passes through the now closed switch means 114 and is compared or computed with the value received from sensing means 74 which is representative of the speed at which the variable speed motor means 72 is moving. Throughout the continual running operation of the machine the speed of the motor means is sensed by sensing means 18 and the speed of the variable speed motor means 72 is determined by sensing means 74. These two speeds are continually compared so it may be said that the sensing means 74 serves to "track" the speed of the main drive motor means 16. That is to say, if the speed of the main drive motor means 16 increases, a higher value will be produced by the sensing means 18 and that higher value will in turn be compared in the error amplifier means 104 to the value from sensing means 74 which is the sensed value of the speed of the variable speed motor means 72 and the difference between the values will be fed to the motor means 72 via the power amplifier means 132 so as to increase or decrease the speed of the motor means 72 so that it may properly be operated in sequential operation according with the speed of the motor means 16. Returning now to the adjustability means 162 it may be seen that the value produced by the impulses from the motor means 16 may be increased or decreased by these adjustable means 162 so that the variable speed motor means 72 will be driven in a ratio higher or lower than the speed at which the main motor means 16 is driven so that a predetermined ratio between these motors, as may be necessary, can also be easily adjusted into the system.

OPERATION OF THE MACHINE

Figure 6:
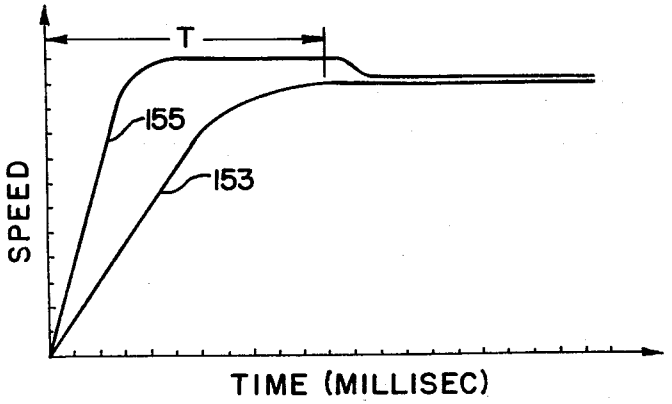
FIG. 6 is a graph of the speed of the main drive motor of the sewing machine and the variable speed motor associated with the present invention.

It should be appreciated that prior to the start of the sewing cycle the feed roller is in the position shown in FIG. 3. Upon initiation of the sewing cycle the logic system of the machine actuates the force drive member means 60 whereby the feed roller 58 is advanced or moved to the position shown in FIG. 4. At the same time as the force drive member 60 is actuated an impulse is delivered via line 110 of the electronic circuitry whereby closing the switch means 118. In closing the switch means 118 it allows the predetermined pre-sew value or speed set by the adjusting means 124 to be fed into the error amplifier means 104, which compares that pre-sew value with the value received from the sensor means 74 on the variable speed motor 72. Since at this time the variable speed motor means 72 has not begun to advance, the value received from the sensor means 74 will be zero. Therefore the error amplifier means 104 will deliver a signal to the power amplifier means 132 representative of the difference between the predetermined pre-sew value and the sensing means value whereby in turn actuation of the variable speed motor means 72 will occur. The actuation of the motor means 72 will drive the feed roller means at that predetermined speed set by the adjustable means 124. As mentioned above the logic system controls the length of time that the pre-sew operation will last. That is, the logic system of the machine will determine how long the roller means 58 will advance the workpiece through the sewing station before the initial sewing operation of the machine 10 occurs. Once the pre-sew portion of the sewing cycle has expired the logic system removes the impulse from line 110 whereby opening the switch means 118 and directs an impulse to line 108 which is operative to close switch 116. By closing switch 116 the preset value set by the adjustable means 122 and representative of the transitional speed delivers a value to the error amplifier means 104 which compares that value with the value received from the sensing means 74 still turning at the preset pre-sew speed. The difference between the transitional speed value and this presew value is directed to the power amplifier means 132 which in turn controls the speed of the variable speed motor means 72. This in turn drives the feed roller means 58 at a predetermined speed set by the adjustable means 122. In this manner it is possible to develop full torque at the feed roller means 58 prior to the time that the sewing machine 10 reaches its full speed. Turning now to FIG. 6 wherein is shown a speed/time graph representative of the main drive motor means represented by line segment 155 and a speed/time graphic representation of the speed of the variable speed motor means 72 shown by line setment 155. The transition time is that portion of the graph represented at "T" whereas it is apparent the torque of the motor means 72 and therefore the pulling torque of the feed roller means 58 driven thereby is developed much quicker than is the full torque of the machine 10. it should also be apparent from the electronic diagram shown in FIG. 7 that it is possible to vary this transition time by adjusting the adjustable means 122 so as to suit the particular purpose. In the present embodiment the transition time or the speed/time ratio of the motor means 72 compared to the speed/time ratio of the main drive means 16 is much quicker in view of the fact that a portion of the workpiece is moved out of its regular path and by increasing the speed of the feed roller means it is possible to bring that portion of the workpiece back into its correct alignment. This is made possible by the increase in the feeding rate between the feed roller means 58 and the feed mechanism of the machine which places a component force vector on the workpiece whereby pulling same back into its proper alignment. Once the transition period has ended, as it predetermined by the time delay circuit means 144, switch means 116 is opened and switch means 114 becomes closed. This is the period of the sewing cycle time in which "tracking" of the main drive motor means 16 occurs. That is the sensing means 18 associated with the main drive motor means 16 produces a first set or signals representative of the speed of the main drive motor means and this is fed into the error amplifier means 104 via the above identified system. Here again, the speed of the main drive motor means 16 is compared to the speed of the variable speed drive motor means 72 whereby it may be said that the main motor means produces a controlling signal and the variable speed drive motor means is driven at a speed which is a function of the speed of the main drive motor means 16 and as shown in FIG. 6 it may be set at any predetermined value so as to run just slightly faster than the feed advancement rate of the machine so as to concomitantly aid in feeding of the workpiece through the sewing station.

Thus it is apparent that there has been provided, in accordance with the invention, an Auxiliary Feed Mechanism For Sewing Machines that fully satisfies the objects, aims, and advantages set forth above while the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An auxiliary work feeding means for use in combination with a sewing machine mounted on a support means and having a frame means, needle means, motor means operatively coupled with said needle means for moving same into and out of a work engaging position, means operative to advance the work to said needle means, and means operative to actuate said machine in a timed sequence, said auxiliary work feeding means comprising:

a feed roller means adapted for movement between two positions, wherein said feed roller means is operative in one but not the other of said positions to concomitantly advance the workpiece with said means operative to advance;

first sensing means for producing a first set of signals representative of the speed of said motor means;

means for driving said feed roller means at variable speeds;

second sensing means adapted to produce a second set of signals representative of the speed of said means for driving; and electrical circuitry means adapted to actuate the means for driving said feed roller means in response to said means operative to actuate and to track the speed of said motor means whereby any increase or decrease in the motor means speed will effect the feeding rate of the feed roller.

2. An auxiliary work feeding means according to claim 1 further including a freely rotatable roller means mounted on said support means and arranged for operative association with said feed roller means for advancing the work therebetween.

3. The auxiliary work feeding means of claim 1 further including a pivotally mounted bracket means adapted to carry said feed roller means, a force driver means operable in response to said means operable to actuate and associated with said bracket means for moving said feed roller means between said two positions in timed relation to the machine cycle.

4. The auxiliary work feeding means of claim 3 further including a freely rotatable assemblage means carried by said pivotally mounted bracket means, and a flexible coupling means operatively connecting said freely rotatable assemblage means with said feed roller means and another flexible coupling means operatively connecting said freely rotatable assemblage means with said means for driving said feed roller means whereby actuation of said means for driving said feed roller means results in displacement of said feed roller means.

5. The auxiliary work feeding means of claim 4 wherein one of said flexible coupling means comprises:

a first sprocket operatively associated with said means for driving said feed roller;

a second sprocket means carried by said freely rotatable assemblage means;

a first force transfer means entrained about said first and second sprocket means for imparting rotation to said freely rotatable assemblage means upon actuation of said means for driving said feed roller means; and said other flexible coupling means comprises:

a third sprocket means carried by said freely rotatable assemblage means;

a fourth sprocket means operatively associated with said feed roller means;

a second force transfer means entrained about said third and fourth sprocket means for imparting motion to said feed roller means upon actuation of said means for driving said feed roller means.

6. The auxiliary work feeding means of claim 5 wherein the aforesaid coupling means are effective to consistently transmit power to said feed roller means while allowing reciprocation of said feed roller means between said two positions.

7. In combination with a sewing machine having a motor means, a stitch forming instrumentality driven by said motor means, means for advancing a workpiece to said stitch forming instrumentality, control means for actuating said machine at timed intervals, and an auxiliary feed mechanism means comprising:

feed roller means;

drive means associated with said feed roller means for moving same;

sensing means for producing a first signal representative of the speed of said drive means; and an electrical circuitry means comprising:

first operative means responsive to actuation by said control means and operable to actuate said drive means at a first predetermined speed, including means for producing a second signal representative of said first predetermined speed;

second operative means responsive to actuation by said control means and operable to drive said drive means at a second predetermined speed including means for producing a third signal representative of said second predetermined speed;

means adapted to receive and compute the difference between said first signal and said second or third signal including means operative to influence actuation of said drive means according to the difference in values therebetween.

8. The combination according to claim 7 further including sensing means for producing a fourth signal representative of the speed of said motor means.

9. The combination according to claim 8 wherein the electronic circuitry means further includes a third operative means adapted to receive the signal representative of the speed of said motor means and to supply this signal to said means adapted to receive and compute whereat said signal representative of the speed of said motor means is compared with the first signal received from said sensing means and any difference therebetween is fed to said means operative to influence actuation of said drive means according to the difference in values therebetween so that upon actuation of said third operative means the actuation of said drive means will be at a speed which is a function of the speed of said motor means.

10. The combination according to claim 9 wherein the second operative means is operable to actuate said drive means at a speed which imparts to said feed roller means a feed rate which is greater than the feed rate at which said means for advancing moves the workpiece.

11. The combination according to claim 10 wherein said second operative means includes a time delay circuit means operative at the onset of the sewing cycle to delay actuation of said drive means at a speed which is a function of said motor means so as to allow the feed roller means under the influence of said second operative means to impart to the workpiece a force which is non-parallel to the force exerted on the workpiece by the means for advancing.

12. The combination according to claim 9 wherein said third operative means includes means for adjusting the value representative of the speed of the motor means whereby allowing adjustment of the ratio between the feed rate of the feed roller means and the feed rate of the means for advancing a workpiece.

13. In combination with a sewing apparatus having various operating parameters, an auxiliary feed mechanism means comprising, a feed roller means, a motor means operatively coupled with said feed roller means for driving the latter at various speeds, and an arrangement for controlling the speed of the motor means in accordance with a particular operating parameter of said sewing apparatus comprising:

first signal furnishing means furnishing, as a function of one operating parameter of said sewing apparatus, a first signal signifying the desired feed rate of said workpiece during said one operating parameter;

second signal furnishing means furnishing a signal signifying the speed of said motor means;

third signal furnishing means furnishing as a function of a second operating parameter of said sewing apparatus, a second signal signifying the desired feed rate of said workpiece during said second operating parameter; and means connected to said first, second and third signal furnishing means for comparing the first or second signal means against the signal signifying the speed of said motor means and furnishing a speed signal to said motor means signifying the difference between said signal signifying the speed of said motor means and said first or second signal whereby increasing or decreasing the speed of said motor means upon receipt of said speed signal.

14. In combination with a machine including a tool for performing operations on a workpiece, a drive motor for actuating said tool, means for producing a first electrical output signal representative of the speed of said drive motor and an apparatus for positioning said workpiece relative said tool comprising:

means for advancing said workpiece past said tool;

at least one auxiliary motor adapted to drive said means for advancing at various speeds;

means for producing a second electrical output signal representative of the speed of said auxiliary motor;

bracket means adapted to mount said advancing means for movement between two positions, in one of which said advancing means is operative to move said workpiece past said tool and in the other of which said advancing means is rendered ineffective to transmit motive power to said workpiece; and means adapted to vary the speed of said auxiliary motor in a predetermined manner so as to initially effect displacement of said workpiece in a predetermined manner relative said tool and then drive said auxiliary motor and said drive motor at a preselected ratio whereby the workpiece is moved past said tool according to the speed of the drive motor.

15. In combination with a sewing machine having a frame, a needle for performing operations on a workpiece, a drive motor for actuating said needle, means for producing a first electrical output signal representative of the speed of said dirve motor, and an apparatus for positioning said workpiece relative said needle comprising:

means for advancing said workpiece past said needle;

at least one auxiliary motor adapted to drive said means for advancing at various speeds;

means for producing a second electrical output signal representative of the speed of said auxiliary motor; and means adapted to vary the speed of said auxiliary motor in a predetermined manner so as to initially effect displacement of said workpiece in a predetermined manner relative said needle and then drive said auxiliary motor and said drive motor at a preselected ratio different from the above speed whereby the workpiece is moved past said needle according to the speed of the drive motor.

16. The sewing machine of claim 15 wherein the apparatus further includes means for moving said advancing means between two positions, in one of which said advancing means is operative to advance said workpiece past said needle and in the other of which said advancing means is rendered ineffective to transmit motive power to said workpiece.

17. The sewing machine of claim 16 wherein the same means for moving said advancing means comprises:

a bracket means moveable toward and away from said work support means; and means for rotatably securing said advancing means to said bracket means.

18. The sewing machine of claim 15 wherein said apparatus further includes means adapted to adjust the entire apparatus relative the frame of the machine.

19. An apparatus according to claim 15 wherein said means for advancing is non-mechanically linked to said machine.

* * * * *